US012193485B1

(12) United States Patent
He

(10) Patent No.: US 12,193,485 B1
(45) Date of Patent: Jan. 14, 2025

(54) ELECTRONIC CIGARETTE HAVING A PLURALITY OF LIQUID STORAGE TANKS

(71) Applicant: PAX Innovations (Shenzhen) Limited, Shenzhen (CN)

(72) Inventor: Wei He, Shenzhen (CN)

( * ) Notice: Subject to any disclaimer, the term of this patent is extended or adjusted under 35 U.S.C. 154(b) by 0 days.

(21) Appl. No.: 18/623,483

(22) Filed: Apr. 1, 2024

(30) Foreign Application Priority Data

Mar. 8, 2024 (CN) ..... 202420471044.1

(51) Int. Cl.

| | |
|---|---|
| ***A24F 40/30*** | (2020.01) |
| ***A24F 40/10*** | (2020.01) |
| ***A24F 40/42*** | (2020.01) |
| ***A24F 40/44*** | (2020.01) |
| ***A24F 40/485*** | (2020.01) |
| ***A24F 40/51*** | (2020.01) |

(52) U.S. Cl.
CPC ..... *A24F 40/30* (2020.01); *A24F 40/10* (2020.01); *A24F 40/42* (2020.01); *A24F 40/44* (2020.01); *A24F 40/485* (2020.01); *A24F 40/51* (2020.01)

(58) Field of Classification Search
CPC ..... A24F 40/30; A24F 40/485; A24F 40/10; A24F 40/42; A24F 40/40
See application file for complete search history.

(56) References Cited

U.S. PATENT DOCUMENTS

| | | | | |
|---|---|---|---|---|
| 11,470,878 | B1 * | 10/2022 | Dargan | A24F 40/46 |
| 2016/0095356 | A1 * | 4/2016 | Chan | A24F 40/30 392/390 |
| 2019/0124982 | A1 * | 5/2019 | Atkins | A24F 40/30 |
| 2020/0163382 | A1 * | 5/2020 | Trzecieski | A24F 40/46 |
| 2021/0298355 | A1 * | 9/2021 | Xing | A24F 40/10 |
| 2022/0160031 | A1 * | 5/2022 | Griffin | A24F 40/42 |
| 2022/0400749 | A1 * | 12/2022 | Park | A24F 40/30 |
| 2023/0000156 | A1 * | 1/2023 | Griffin | A24F 40/42 |
| 2023/0148661 | A1 * | 5/2023 | Liang | A24F 40/30 131/329 |
| 2023/0292839 | A1 * | 9/2023 | Kim | A24F 40/44 131/329 |

* cited by examiner

*Primary Examiner* — Hae Moon Hyeon

(57) ABSTRACT

An electronic cigarette includes a main body of electronic cigarette, and a plurality of liquid storage tanks for storing tobacco liquid. The main body of electronic cigarette is provided with a liquid storage chamber for storing tobacco liquid and at least one installation chamber for installing the liquid storage tanks. One side of the installation chamber is a first opening. Each liquid storage tank is installed corresponding to one installation chamber, or the installation chamber is used for accommodating at least two liquid storage tank. Each liquid storage tank is equipped with a liquid outlet hole for liquid discharge. The liquid storage tanks are at least partially installed in the installation chamber, and the liquid outlet hole is in communication with the liquid storage chamber, thereby increasing a capacity of the electronic cigarette to store tobacco, increasing puffs for users, and improving a service life of the electronic cigarette.

19 Claims, 7 Drawing Sheets

ELECTRONIC CIGARETTE HAVING A PLURALITY OF LIQUID STORAGE TANKS

CROSS-REFERENCE TO RELATED APPLICATIONS

The application claims priority of Chinese patent application CN202420471044.1, filed on Mar. 8, 2024, which is incorporated herein by reference in its entireties.

TECHNICAL FIELD

The present invention relates to a technical field of electronic products, in particular to an electronic cigarette.

BACKGROUND ART

As is well known, when a disposable electronic cigarette leaves the factory, a capacity of the disposable electronic cigarette is fixed, and a capacity of a battery is also fixed. After tobacco liquid or an electrical quantity of the battery is used up, a service life of the disposable electronic cigarette ends. However, generally, when the disposable electronic cigarette is configured, the usage time of the electrical quantity of the battery is set to be greater than the time when the tobacco liquid is used up. The tobacco liquid cannot be expanded, and a total number of puffs is small, thereby affecting the service life of the disposable electronic cigarette and failing to meet the needs of users.

SUMMARY

A main purpose of the present invention is to provide an electronic cigarette for solving a problem of insufficient puffs due to the inability to expand the tobacco liquid of an existing disposable electronic cigarette.

In order to solve the above-mentioned technical problem, a technical solution is provided by the present invention.

An electronic cigarette includes a main body of electronic cigarette and a plurality of liquid storage tanks for storing tobacco liquid.

The main body of electronic cigarette is equipped with a liquid storage chamber for storing tobacco liquid, and the main body of electronic cigarette is provided with at least one installation chamber for installing the liquid storage tanks. A first opening is defined at one side of the installation chamber.

Each of the liquid storage tanks is installed corresponding to one installation chamber, or the installation chamber is used for accommodating at least two of the liquid storage tanks.

Each of the liquid storage tanks is equipped with a liquid outlet hole for liquid discharge. The liquid storage tanks are at least partially installed in the installation chamber, and the liquid outlet hole is in communication with the liquid storage chamber.

Furthermore, the liquid storage tanks are non-detachably positioned within the installation chamber.

Furthermore, the liquid storage tanks are detachably installed in the installation chamber.

Furthermore, the liquid storage tanks are fixed in the installation chamber in a buckle form.

Furthermore, the liquid storage tanks are in interference fit with a side wall of the installation chamber.

Furthermore, one end of the liquid storage tanks is provided with an insertion end, and the liquid outlet hole penetrates through the insertion end. The installation chamber is provided with an insertion hole, and the insertion hole is in communication with the liquid storage chamber. The insertion end is placed inside the insertion hole.

Furthermore, a first sealing ring is provided between the insertion end and a side wall of the insertion hole.

Furthermore, a side projection of the first sealing ring is in a shape of "I" in upper case. An inner side wall of the first sealing ring is provided with a sealing protrusion for abutting against an outer side wall of the insertion end.

Furthermore, the main body of electronic cigarette is equipped with a liquid passing chamber on an outer side of the liquid storage chamber. A liquid passing hole is defined on a side wall of the liquid storage chamber, and the liquid passing hole is in communication with the liquid passing chamber. The insertion hole is in communication with the liquid passing chamber.

Furthermore, a total number of the liquid storage chamber is one, and liquid absorbing cotton is arranged inside the liquid storage chamber for adsorbing tobacco liquid.

Furthermore, the main body of electronic cigarette is equipped with a circuit board, a pneumatic switch and a battery below the liquid storage chamber. Both the battery and the pneumatic switch are electrically connected to the circuit board. The pneumatic switch is positioned at a bottom of the main body of electronic cigarette. The bottom of the main body of electronic cigarette is provided with an air inlet hole at a position corresponding to the pneumatic switch, and the air inlet hole is in communication with the liquid storage chamber.

Furthermore, a bottom of the liquid absorbing cotton is equipped with a heating wire. The heating wire is electrically connected to the circuit board. The liquid absorbing cotton is in an annular shape. The heating wire is positioned on a central axis of the liquid absorbing cotton.

Furthermore, the main body of electronic cigarette is provided with an installation seat and an adapter board below the liquid storage chamber. The adapter board is electrically connected to the circuit board. The adapter board is positioned at a bottom of the installation seat. The installation seat is provided with a wiring hole for a pin of the heating wire to pass through.

Furthermore, the installation seat and the adapter board are both provided with an avoidance hole. A position limiting slot is provided at a bottom of the installation seat. The installation seat is made of soft rubber. The adapter board is placed inside the position limiting slot. The wiring hole is in communication with the position limiting slot.

Furthermore, a top of the main body of electronic cigarette is equipped with a mouthpiece with an aerosol outlet hole. The mouthpiece is positioned at a top of the liquid storage chamber, and the liquid storage chamber is in communication with the aerosol outlet hole. A central axis of the aerosol outlet hole, a central axis of the liquid absorbing cotton, and a central axis of the avoidance hole are in an identical straight line.

Furthermore, a direction of the first opening is downward. The insertion end is positioned at a top of the liquid storage tanks. The insertion hole is positioned at a bottom of the liquid passing hole, and the installation chamber is positioned below the liquid passing hole.

Furthermore, a total number of the liquid storage tanks is two, and a total number of the installation chambers is two. The two installation chambers are positioned below the liquid passing chamber. The circuit board, the battery, the adapter board, and the installation seat are all positioned between the two installation chambers.

Furthermore, the main body of electronic cigarette includes: a first top housing, an outer housing connected to the first top housing, a middle housing body, and an annular housing body. The middle housing body and the annular housing body are arranged within the outer housing. The mouthpiece is positioned on the first top housing. The installation chambers are positioned on the outer housing. The first opening is positioned at a bottom of the outer housing.

The liquid passing chamber is positioned on the middle housing body, and a receiving slot is defined at a bottom of the liquid passing chamber. The annular housing body at least partially passes through the liquid passing chamber and then is placed in the receiving slot. The liquid passing hole is positioned on the annular housing body. The liquid passing chamber is annular and surrounds an outer side of the liquid storage chamber.

A side wall of the receiving slot is equipped with a protruding position limiting ring, and a slot is defined on an outer side wall of the installation seat. The position limiting ring is placed inside the slot.

Furthermore, the middle housing body includes a second top housing and a middle outer housing. The middle outer housing is connected to the second top housing to form the liquid passing chamber. The position limiting slot and the position limiting ring are both positioned on the middle outer housing. A second sealing ring is arranged between the second top housing and the middle outer housing, and a third sealing ring is arranged between the annular housing body and the first top housing. The installation seat is at least partially positioned at a bottom of the annular housing body and a bottom surface of the receiving slot.

Furthermore, the outer housing includes an external outer housing and a bottom housing. An upper end and a lower end of the external outer housing are respectively connected to the first top housing and the bottom housing. The first opening is positioned on the bottom housing. The bottom housing is provided with an accommodating slot in a middle of the two installation chambers. The circuit board, the battery, and the pneumatic switch are all arranged in the accommodating slot.

Compared to existing technology, in the present invention, by configuring the installation chamber on the main body of electronic cigarette, and subsequently installing a plurality of liquid storage tanks on the main body of electronic cigarette, and by communicating the liquid outlet hole with the liquid storage chamber, a capacity of the electronic cigarette for storing tobacco liquid is increased, a total number of puffs for users is increased, and a service life of the electronic cigarette is improved.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
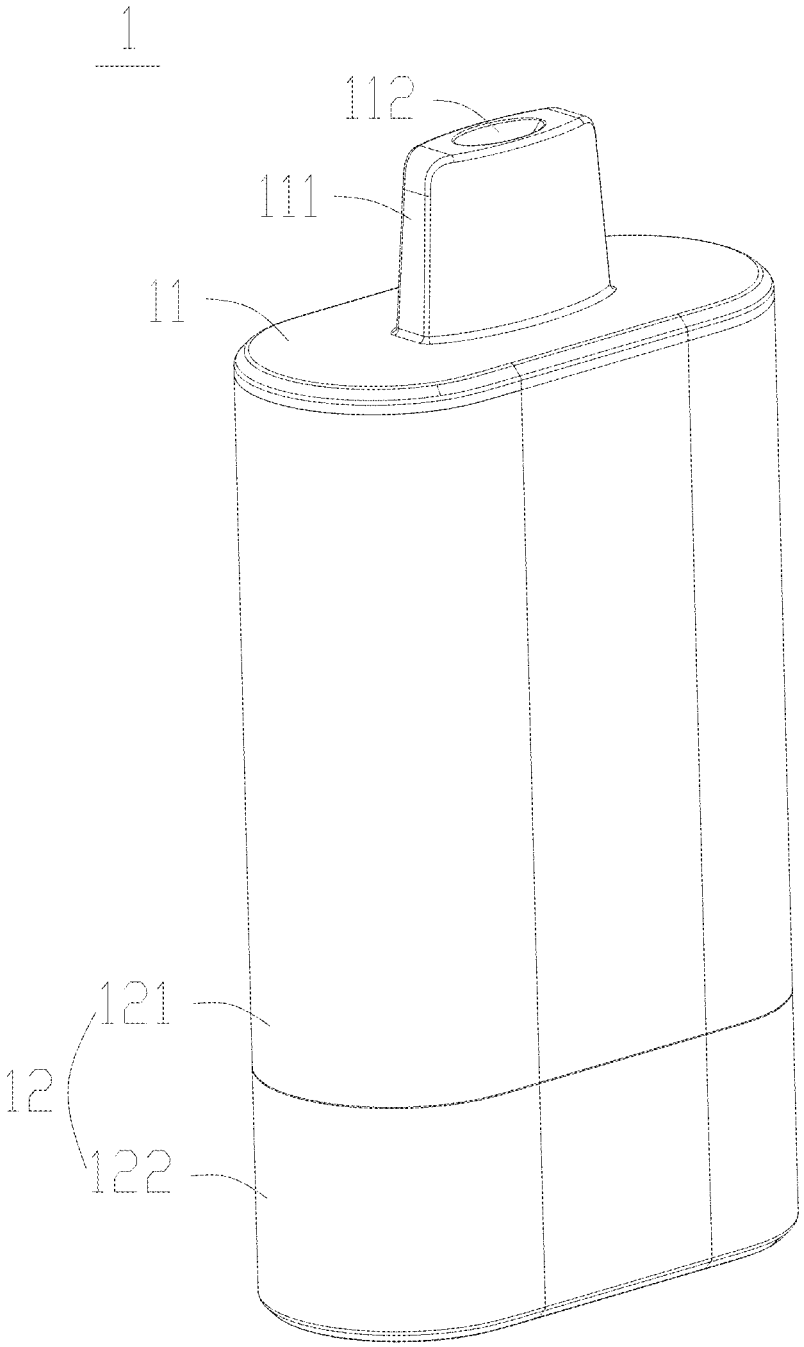
FIG. 1 is a perspective view according to the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
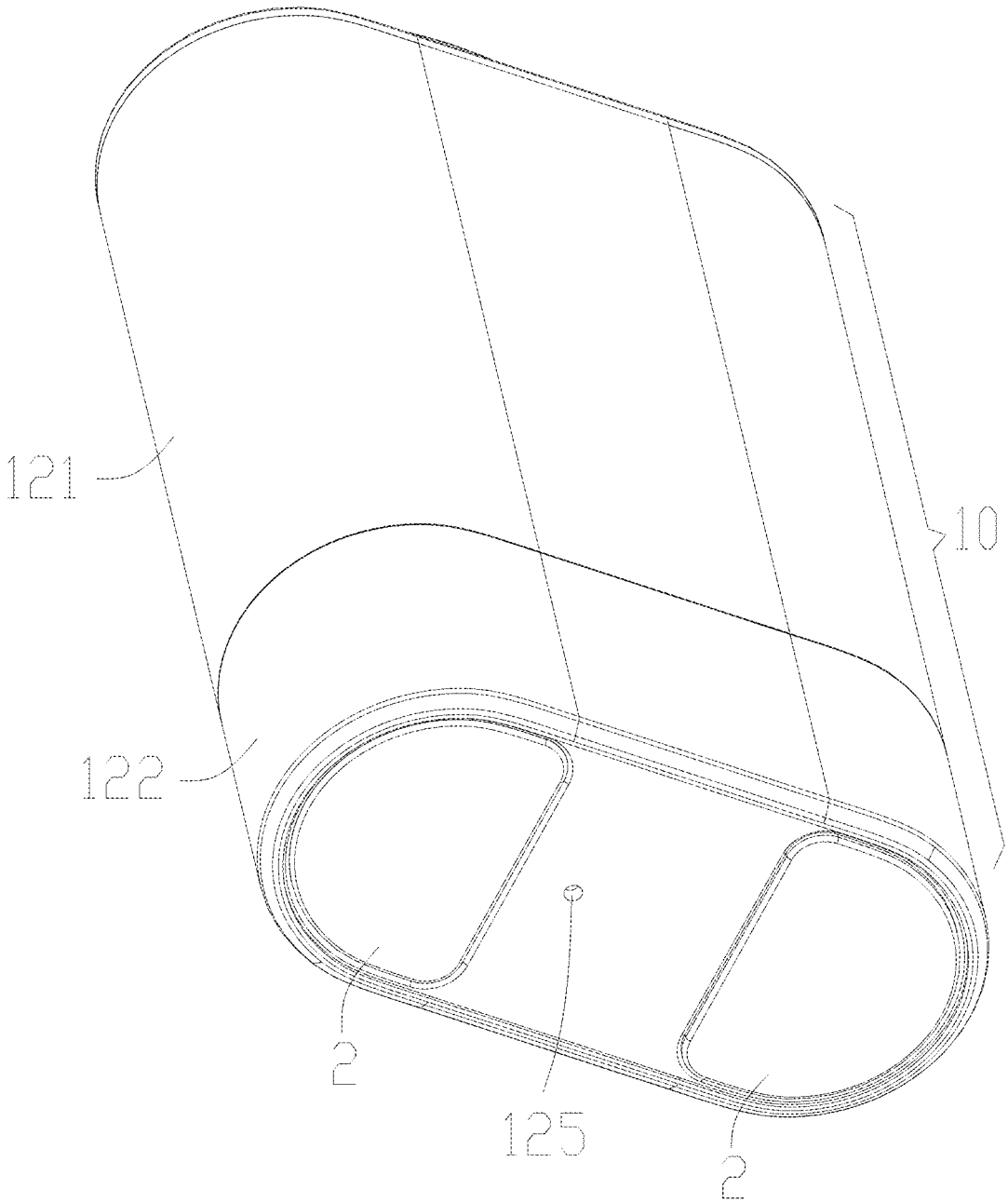
FIG. 2 is a perspective view from another perspective according to the present invention.
Figure 3:
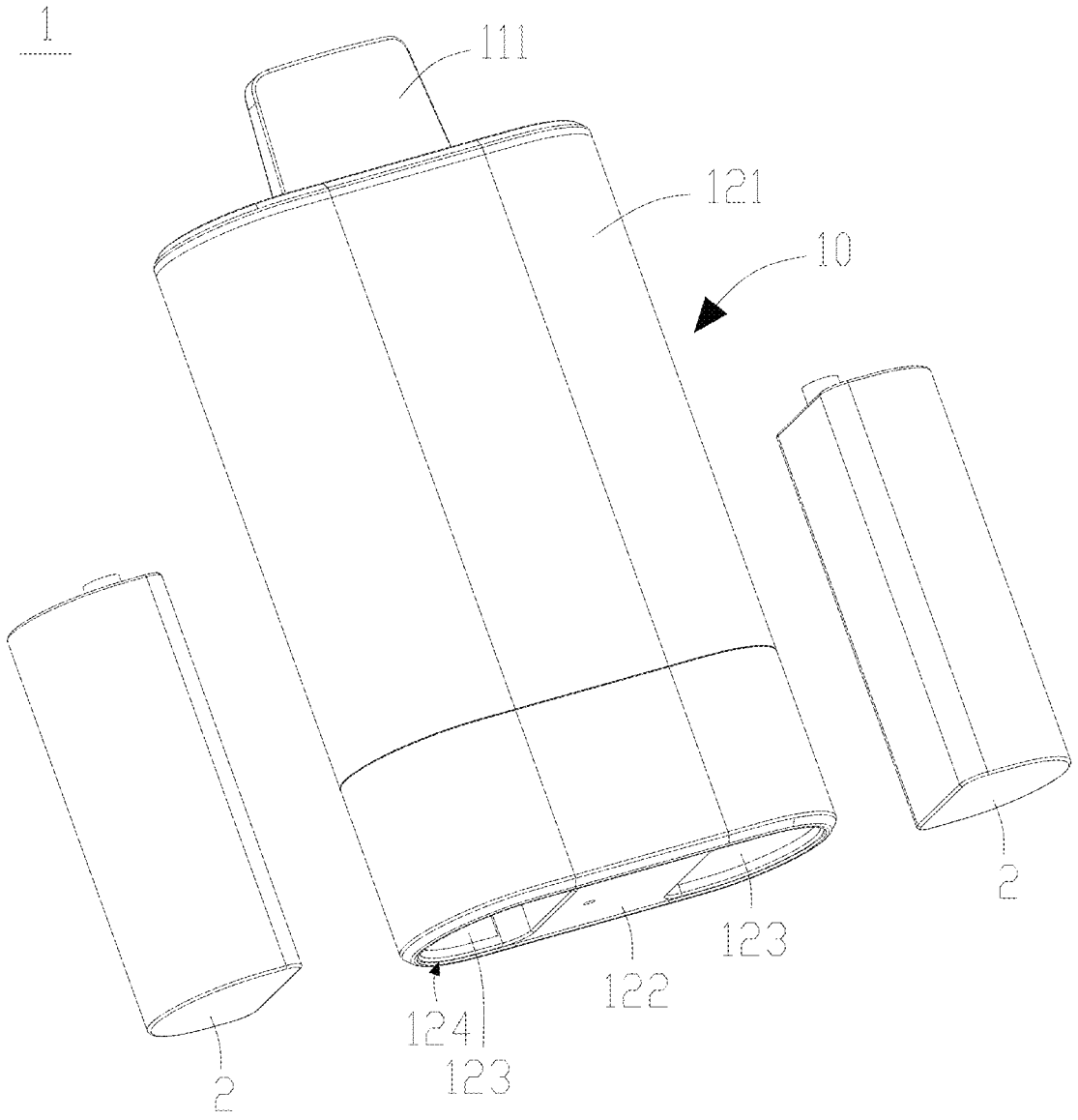
FIG. 3 is an exploded view of a main body of electronic cigarette and liquid storage tanks according to the present invention.
Figure 4:
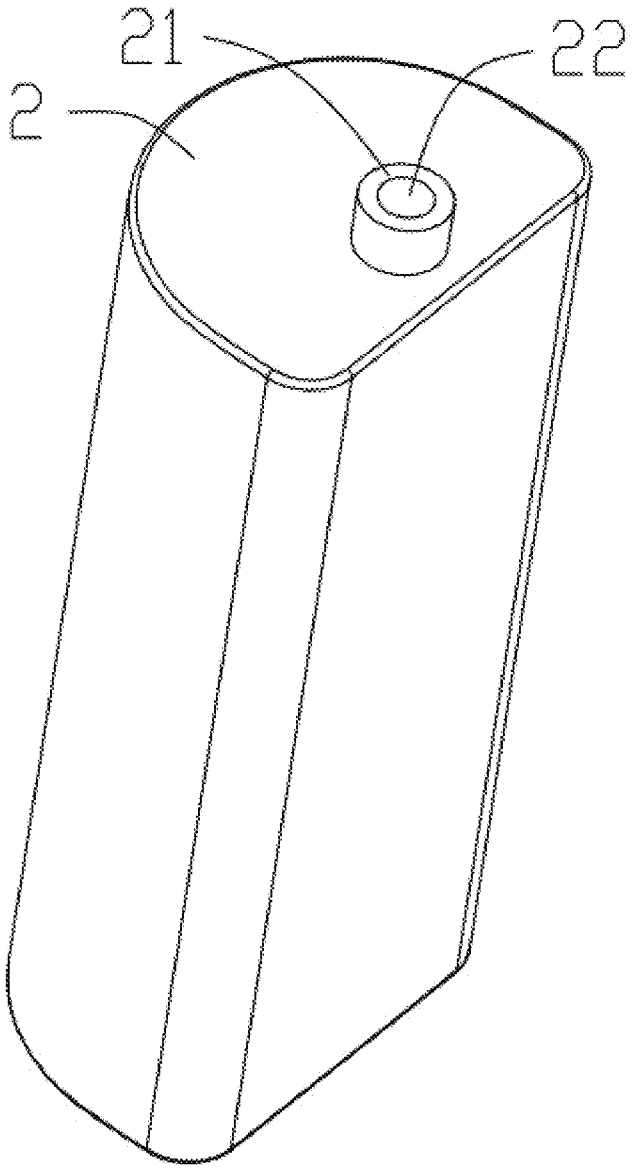
FIG. 4 is a structural diagram of a liquid storage tank according to the present invention.
Figure 5:
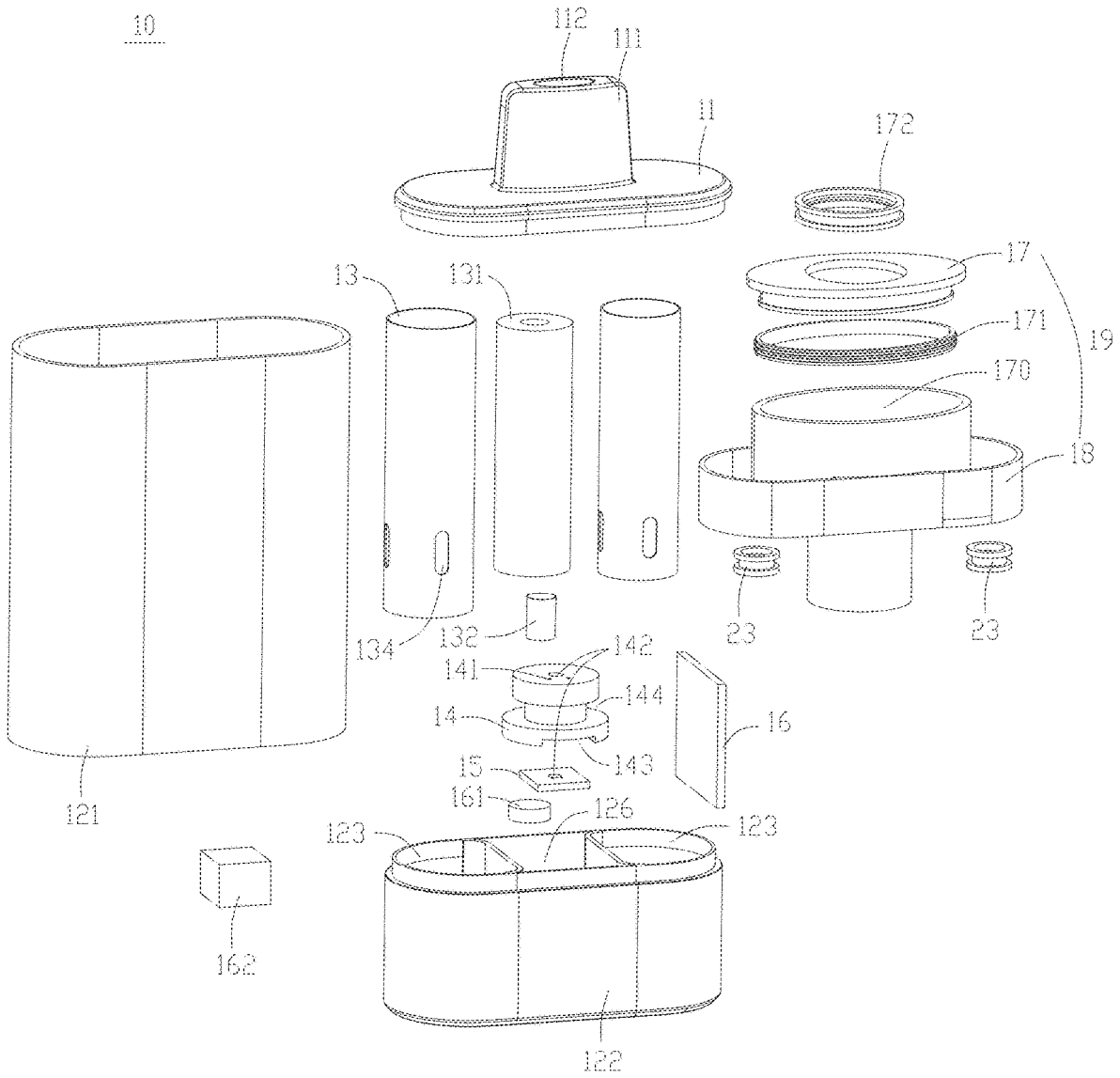
FIG. 5 is an exploded view of a main body of electronic cigarette according to the present invention.
Figure 6:
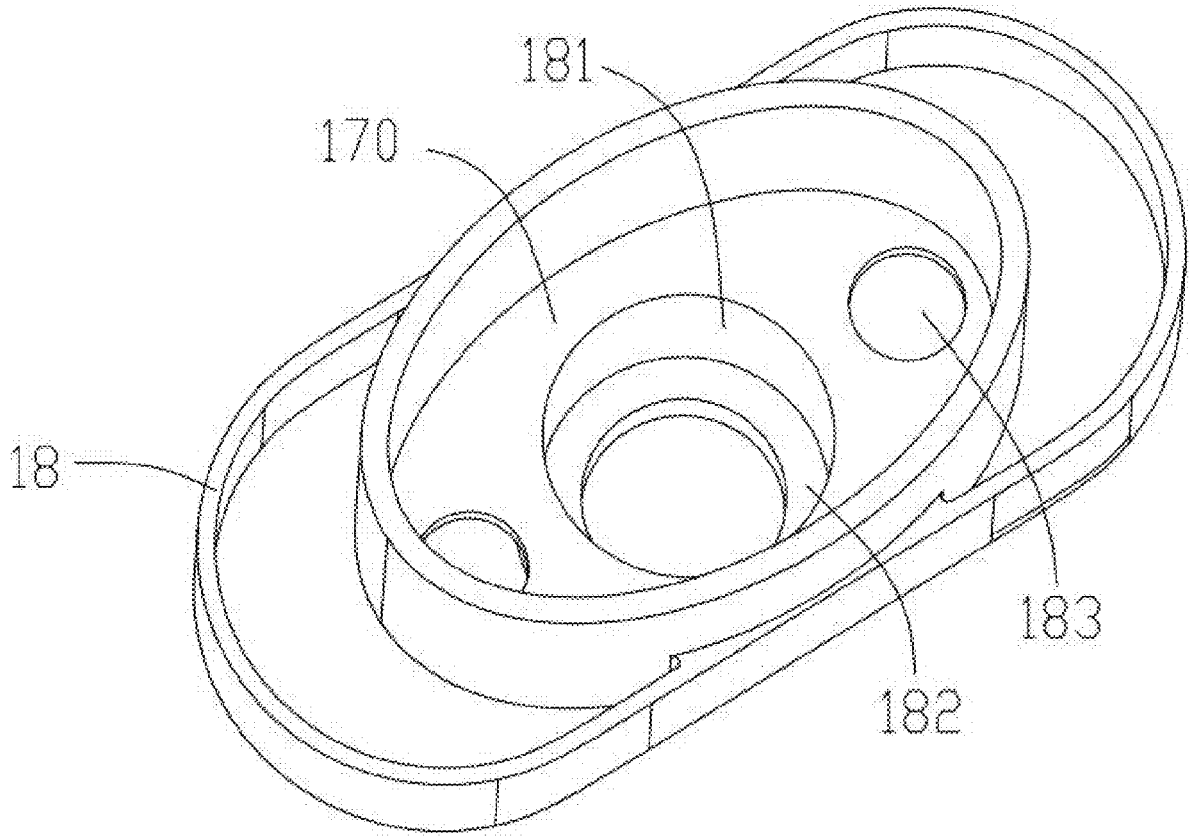
FIG. 6 is a structural diagram of a middle outer housing according to the present invention.
Figure 7:
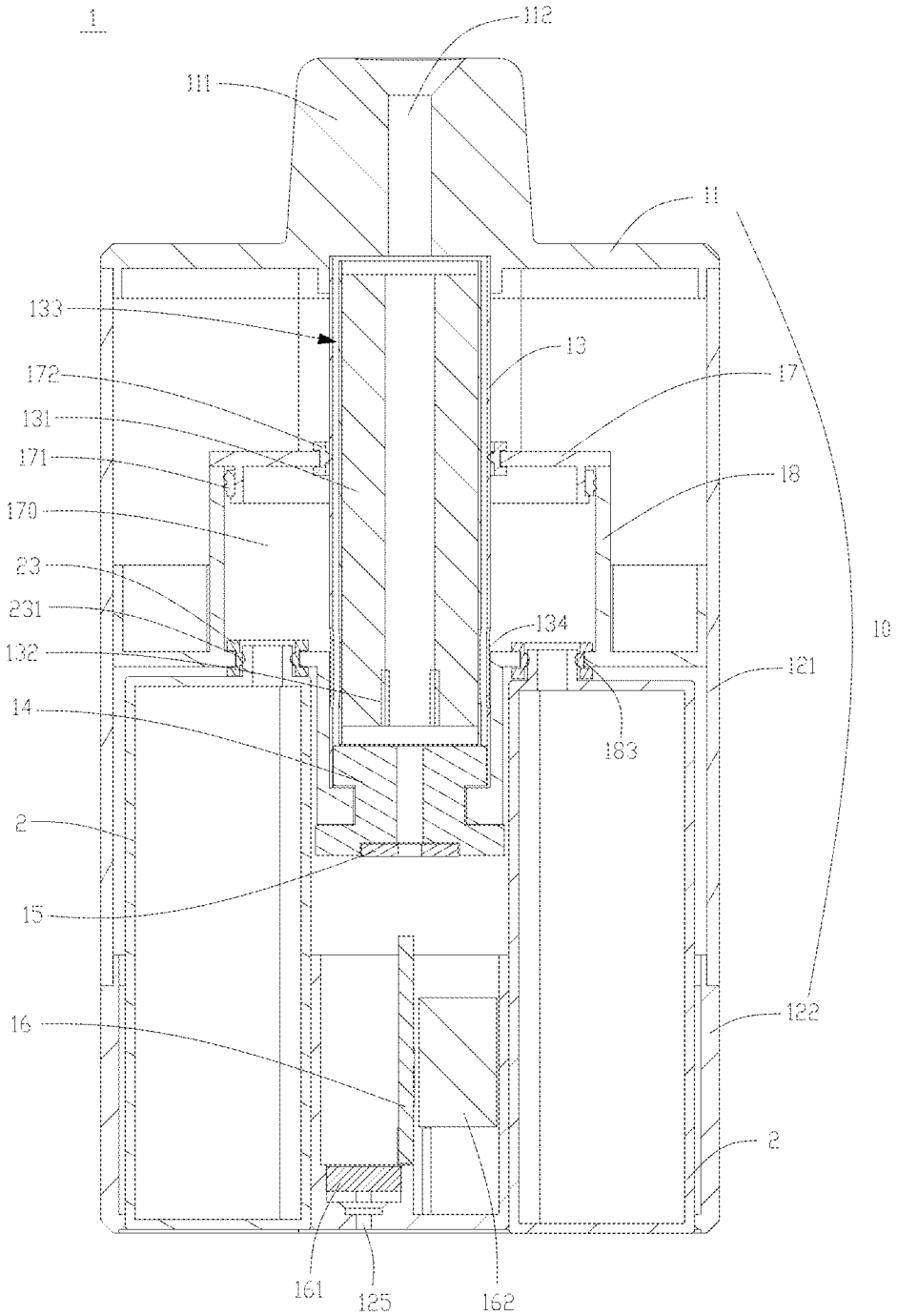
FIG. 7 is a section view along a central axis according to the present invention.

FIGS. 1-7 show an electronic cigarette 1 according to an embodiment of the present invention.

The electronic cigarette 1 includes a main body 10, and a plurality of liquid storage tanks 2 for storing tobacco liquid. The main body 10 is equipped with a liquid storage chamber 133 for storing tobacco liquid, and the main body 10 is provided with at least one installation chamber 123 for installing the liquid storage tanks 2. A first opening 124 is defined at one side of the installation chamber 123. Each of the liquid storage tanks 2 is installed corresponding to one installation chamber 123, or the installation chamber 123 is used for accommodating at least two of the liquid storage tanks 2. Each of the liquid storage tanks 2 is equipped with a liquid outlet hole 22 for liquid discharge. The liquid storage tanks 2 are at least partially installed in the installation chamber 123, and the liquid outlet hole 22 is in communication with the liquid storage chamber 133.

In the present invention, by configuring the installation chamber 123 on the main body 10, and subsequently installing a plurality of liquid storage tanks 2 on the main body 10, and by communicating the liquid outlet hole 22 with the liquid storage chamber 133, a capacity of the electronic cigarette for storing tobacco liquid is increased, a total number of puffs for users is increased, and a service life of the electronic cigarette is improved. Users can configure a total number of the liquid storage tanks 2 according to their needs. Specifically, in one embodiment, a total number of the installation chamber 123 can be one, that is, one installation chamber 123 is capable of accommodating a plurality of liquid storage tanks 2. Of course, in other embodiments, the total number of the installation chambers 123 can also be multiple to correspond to the installation of the plurality of liquid storage tanks 2. The total number of the installation chamber 123 is not limited here.

In one embodiment, the installation chamber 123 can be positioned below, above, on a left side, on a right side, on a front end or on a rear end of the liquid storage chamber 133, that is, the liquid storage tanks 2 can be inserted into the installation chamber 123 from below the main body 10 from bottom to top to achieve installation. That is, to allow the tobacco liquid inside the liquid storage tanks 2 to enter the liquid storage chamber 133, the electronic cigarette needs to be inverted. Alternatively, the liquid storage tanks 2 can be inserted into the installation chamber 123 from above, the left side, the right side, the front end or the rear end of the main body 10 to achieve installation. In this way, the tobacco liquid inside the liquid storage tanks 2 can enter the liquid storage chamber 133 when the users puff, and a loading method of the liquid storage tanks 2 is not limited here.

In one embodiment, at the time of leaving the factory, the liquid outlet hole 22 can be sealed with a cover or a layer of film to prevent the leakage of tobacco liquid.

In one embodiment, after the liquid storage tanks 2 are installed in the installation chamber 123, the liquid storage tanks 2 cannot be disassembled. This method is suitable for a disposable electronic cigarette. In other embodiments, the liquid storage tanks 2 are detachably installed in the installation chamber 123 for the users to replace the liquid storage tanks 2.

In one embodiment, the liquid storage tanks 2 can be partially inserted into the installation chamber 123, or the liquid storage tanks 2 can be fully embedded into the installation chamber 123.

In one embodiment, the liquid storage tanks 2 are fixed in the installation chamber 123 in a buckle form, or the liquid storage tanks 2 are in interference fit with a side wall of the installation chamber 123, etc., so as to install the liquid storage tanks 2 in the installation chamber 123 and prevent the liquid storage tanks 2 from falling out of the installation chamber 123 without external force.

In one embodiment, one end of the liquid storage tanks 2 is provided with an insertion end 21, and the liquid outlet hole 22 penetrates through the insertion end 21. The main body 10 further includes a middle housing body 18 and an annular housing body 13, the middle housing body 18 includes a liquid passing chamber 170, the liquid passing chamber 170 is located on an outer side of the annular housing body 13, the middle housing body 18 includes an insertion hole 183, and the insertion hole 183 is in communication with the liquid storage chamber 133 via the liquid passing chamber 170 and a liquid passing hole 134 defined on a side wall of the annular housing body 13. The liquid passing hole 134 is in communication with the liquid passing chamber 170. The insertion hole 183 is in communication with the liquid passing chamber 170. The insertion end 21 is placed inside the insertion hole 183. By configuring the liquid outlet hole 22 on the insertion end 21, the liquid storage tanks 2 are matched with the insertion hole 183 to improve the stability of the tobacco liquid in the liquid storage tanks 2 entering the liquid storage chamber 133. Of course, in other embodiments, the insertion end 21 can also be arranged on the installation chamber 123.

In one embodiment, a first sealing ring 23 is provided between the insertion end 21 and a side wall of the insertion hole 183 to prevent a gap between the insertion end 21 and the insertion hole 183, thereby playing a role of sealing and liquid leakage preventing.

In one embodiment, the first sealing ring 23 is set on a side wall of the insertion hole 183, and a side projection of the first sealing ring 23 is in a shape of "I" in upper case, which can prevent the first sealing ring 23 from falling off from the insertion hole 183 when the insertion end 21 is placed inside the insertion hole 183. An inner side wall of the first sealing ring 23 is provided with a sealing protrusion 231 for abutting against an outer side wall of the insertion end 21. When the insertion end 21 is placed in the insertion hole 183, the sealing protrusion 231 is capable of abutting against the outer side wall of the insertion end 21 to play a sealing role.

In one embodiment, a total number of the liquid storage chamber 133 is one, and liquid absorbing cotton 131 is arranged inside the liquid storage chamber 133 for adsorbing tobacco liquid. By using the liquid absorbing cotton 131 to adsorb tobacco liquid, when the liquid storage tanks 2 are not installed, the tobacco liquid in the liquid storage chamber 133 can be prevented from leaking out from the insertion hole 183.

In actual use, a capacity of the liquid absorbing cotton 131 to absorb tobacco liquid and a capacity of the tobacco liquid stored inside the liquid storage tanks 2 can be customized by the manufacturers. For example, when the electronic cigarette in this embodiment leaves the factory, the liquid absorbing cotton 131 can adsorb 2 ml of tobacco liquid, and each of the liquid storage tanks 2 can store 10 ml of tobacco liquid. Alternatively, in other embodiments, the liquid absorbing cotton 131 can adsorb 1.8 ml of tobacco liquid, and each of the liquid storage tanks 2 can store 15 ml of tobacco liquid, etc.

In one embodiment, a bottom of the liquid absorbing cotton 131 is equipped with a heating wire 132. The liquid absorbing cotton 131 is in an annular shape. The heating wire 132 is positioned on a central axis of the liquid absorbing cotton 131. Under the tobacco liquid's own gravity, the tobacco liquid will converge towards the bottom of the liquid absorbing cotton 131, so that when the heating wire 132 heats up, the tobacco liquid can be atomized.

In one embodiment, the main body 10 is equipped with a circuit board 16, a pneumatic switch 161 and a battery 162 below the liquid storage chamber 133. The heating wire 132 is electrically connected to the circuit board 16. Both the battery 162 and the pneumatic switch 161 are electrically connected to the circuit board 16. The pneumatic switch 161 is positioned at a bottom of the main body 10. The bottom of the main body 10 is provided with an air inlet hole 125 at a position corresponding to the pneumatic switch 161, and the air inlet hole 125 is in communication with the liquid storage chamber. Power is supplied to the circuit board 16 by the battery 162, so that when the users puff, air enters through the air inlet hole 125, and the pneumatic switch 161 detects a pressure difference and feeds back an electrical signal to the circuit board 16. Based on this electrical signal, the circuit board 16 drives the heating wire 132 to heat up to atomize the tobacco liquid.

The liquid passing chamber 170 is used for transitioning the tobacco liquid flowing out of the liquid storage tanks 2 into the liquid storage chamber 133, making a structure of the electronic cigarette in this embodiment reasonable.

In one embodiment, the main body 10 is provided with an installation seat 14 and an adapter board 15 below the liquid storage chamber 133. The adapter board 15 is electrically connected to the circuit board 16, and the adapter board 15 is positioned at a bottom of the installation seat 14. The installation seat 14 is provided with a wiring hole 141 for a pin of the heating wire 132 to pass through. By threading the pin of the heating wire 132 through the wiring hole 141 and then soldering the pin onto the adapter board 15, the wiring pin of the heating wire 132 is led out by the adapter board 15, thereby facilitating connection with the circuit board 16.

In one embodiment, the installation seat 14 and the adapter board 15 are both provided with an avoidance hole 142. A position limiting slot 143 is provided at a bottom of the installation seat 14. The installation seat 14 is made of soft rubber. The adapter board 15 is placed inside the position limiting slot 143. The wiring hole 141 is in communication with the position limiting slot 143. A top of the main body 10 is equipped with a mouthpiece 111 with an aerosol outlet hole 112. The mouthpiece 111 is positioned at a top of the liquid storage chamber 133, and the liquid storage chamber 133 is in communication with the aerosol outlet hole 112. A central axis of the aerosol outlet hole 112, a central axis of the liquid absorbing cotton 131, and a central axis of the avoidance hole 142 are in an identical straight line. When the users puff through the mouthpiece 111, an airflow enters from a bottom of the main body 10, and after the airflow passes through the avoidance hole 142 and the liquid storage chamber 133, the aerosol generated by the heating wire 132 is discharged from the aerosol outlet hole 112 to be inhaled by the users.

In this embodiment, a direction of the first opening 124 is downward. The insertion end 21 is positioned at a top of the liquid storage tanks 2. The insertion hole 183 is positioned at a bottom of the liquid passing chamber 170. The installation chamber 123 is positioned below the liquid passing chamber 170. That is, the liquid storage tanks 2 can be inserted from a bottom of the main body 10 from bottom to top, so that when the electronic cigarette is placed vertically, the tobacco liquid in the liquid storage tanks 2 can be prevented from entering the liquid storage chamber 133 after passing through the liquid passing chamber 170, preventing a problem of excessive tobacco liquid in the liquid storage chamber 133.

In one embodiment, a total number of the liquid storage tanks 2 is two, and a total number of the installation chambers 123 is two. The two installation chambers 123 are positioned below the liquid passing chamber 170. The circuit board 16, the battery 162, the adapter board 15, and the installation seat 14 are all positioned between the two installation chambers 123 to effectively utilize space and make a volume of the main body 10 compact.

In one embodiment, in order to facilitate the production and manufacturing of the electronic cigarette in this embodiment, the main body 10 includes: a first top housing 11, an outer housing 12 connected to the first top housing 11, the middle housing body 19, and the annular housing body 13. The middle housing body 19 and the annular housing body 13 are arranged within the outer housing 12. The mouthpiece 111 is positioned on the first top housing 11, and the mouthpiece 111 and the first top housing 11 are integrally formed by injection molding. The installation chambers 123 are positioned on the outer housing 12, and the two installation chambers 123 are respectively positioned in a lower left corner and a lower right corner of the outer housing 12. The first opening 124 is positioned at a bottom of the outer housing 12. A receiving slot 181 is defined at a bottom of the liquid passing chamber 170. The annular housing body 13 at least partially passes through the liquid passing chamber 170 and then is placed in the receiving slot 181. The liquid passing hole 134 is positioned on the annular housing body 13, allowing the tobacco liquid from the liquid storage tanks 2 to enter the liquid storage chamber 133 after passing through the liquid passing chamber 170 and the liquid passing hole 134. The liquid passing chamber 170 is annular and surrounds an outer side of the liquid storage chamber 133. A side wall of the receiving slot 181 is equipped with a protruding position limiting ring 182, and a slot 144 is defined on an outer side wall of the installation seat 14. The position limiting ring 182 is placed inside the slot 144, and the position limiting ring 182 plays a role in limiting a position of the annular housing body 13. Moreover, the heating wire 132, the annular housing body 13, and the liquid absorbing cotton 131 together form an atomizing core.

In the above embodiments, in order to facilitate the production and manufacturing of the middle housing body 19, the middle housing body 19 includes a second top housing 17 and a middle outer housing 18. The middle outer housing 18 is connected to the second top housing 17 to form the liquid passing chamber 170. The position limiting slot 143 and the position limiting ring 182 are both positioned on the middle outer housing 18. A second sealing ring 171 is arranged between the second top housing 17 and the middle outer housing 18, and a third sealing ring 172 is arranged between the annular housing body 13 and the first top housing 11. The installation seat 14 is at least partially positioned at a bottom of the annular housing body 13 and a bottom surface of the receiving slot 181, thereby forming one sealed liquid passing chamber 170 to prevent liquid leakage.

In one embodiment, the outer housing 12 includes an external outer housing 121 and a bottom housing 122. An upper end and a lower end of the external outer housing 121 are respectively connected to the first top housing 11 and the bottom housing 122. The outer housing 12 is arranged as two components, allowing a color of the main body 10 to be more diverse to meet the users' pursuit of multiple colors. The first opening 124 is positioned on the bottom housing 122. The bottom housing 122 is provided with an accommodating slot 126 in a middle of the two installation chambers 123. The circuit board 16, the battery 162, and the pneumatic switch 161 are all arranged in the accommodating slot 126.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. An electronic cigarette, comprising a main body and a plurality of liquid storage tanks for storing tobacco liquid;

wherein the main body is equipped with a liquid storage chamber, the main body is provided with at least one installation chamber for installing the liquid storage tanks, and a first opening is defined at one side of the installation chamber;

each of the liquid storage tanks is installed corresponding to one installation chamber, or the installation chamber is used for accommodating at least two of the liquid storage tanks, and each of the liquid storage tanks is disposed in the installation chamber via the first opening;

each of the liquid storage tanks is equipped with a liquid outlet hole for liquid discharge, the liquid storage tanks are at least partially installed in the installation chamber, and the liquid outlet hole is in communication with the liquid storage chamber.

2. The electronic cigarette of claim 1, wherein the liquid storage tanks are non-detachably positioned within the installation chamber.

3. The electronic cigarette of claim 1, wherein the liquid storage tanks are detachably installed in the installation chamber.

4. The electronic cigarette of claim 1, wherein the liquid storage tanks are fixed in the installation chamber in a buckle form.

5. The electronic cigarette of claim 1, wherein the liquid storage tanks are in interference fit with a side wall of the installation chamber.

6. The electronic cigarette of claim 1, wherein one end of the liquid storage tanks is provided with an insertion end, and the liquid outlet hole penetrates through the insertion end; the main body comprises a middle housing body and an annular housing body, the middle housing body comprises a liquid passing chamber, the liquid passing chamber is located on an outer side of the annular housing body, the middle housing body comprises an insertion hole, the insertion hole is in communication with the liquid storage chamber via the liquid passing chamber and a liquid passing hole defined on a side wall of the annular housing body, and the insertion end is placed inside the insertion hole.

7. The electronic cigarette of claim 6, wherein a first sealing ring is provided between the insertion end and a side wall of the insertion hole.

8. The electronic cigarette of claim 7, wherein a side projection of the first sealing ring is in a shape of "I" in upper case, and an inner side wall of the first sealing ring is provided with a sealing protrusion for abutting against an outer side wall of the insertion end.

9. The electronic cigarette of claim 8, wherein a total number of the liquid storage chamber is one, and liquid absorbing cotton is arranged inside the liquid storage chamber for adsorbing tobacco liquid.

10. The electronic cigarette of claim 9, wherein the main body is equipped with a circuit board, a pneumatic switch and a battery below the liquid storage chamber, both the battery and the pneumatic switch are electrically connected to the circuit board, the pneumatic switch is positioned at a bottom of the main body, the bottom of the main body is provided with an air inlet hole at a position corresponding to the pneumatic switch, and the air inlet hole is in communication with the liquid storage chamber.

11. The electronic cigarette of claim 10, wherein a bottom of the liquid absorbing cotton is equipped with a heating wire, the heating wire is electrically connected to the circuit board, the liquid absorbing cotton is in an annular shape, and the heating wire is positioned on a central axis of the liquid absorbing cotton.

12. The electronic cigarette of claim 11, wherein the main body is provided with an installation seat and an adapter board below the liquid storage chamber, the adapter board is electrically connected to the circuit board, the adapter board is positioned at a bottom of the installation seat, and the installation seat is provided with a wiring hole for a pin of the heating wire to pass through.

13. The electronic cigarette of claim 12, wherein the installation seat and the adapter board are both provided with an avoidance hole, a position limiting slot is provided at a bottom of the installation seat, the installation seat is made of soft rubber, the adapter board is placed inside the position limiting slot, and the wiring hole is in communication with the position limiting slot.

14. The electronic cigarette of claim 13, wherein a top of the main body is equipped with a mouthpiece with an aerosol outlet hole, the mouthpiece is positioned at a top of the liquid storage chamber, and the liquid storage chamber is in communication with the aerosol outlet hole; a central axis of the aerosol outlet hole, a central axis of the liquid absorbing cotton, and a central axis of the avoidance hole are in an identical straight line.

15. The electronic cigarette of claim 14, wherein a direction of the first opening is downward, the insertion end is positioned at a top of the liquid storage tanks, the insertion hole is positioned at a bottom of the liquid passing chamber, and the installation chamber is positioned below the liquid passing chamber.

16. The electronic cigarette of claim 15, wherein a total number of the liquid storage tanks is two, a total number of the installation chambers is two, and the two installation chambers are positioned below the liquid passing chamber; the circuit board, the battery, the adapter board, and the installation seat are all positioned between the two installation chambers.

17. The electronic cigarette of claim 16, wherein the main body comprises a first top housing, an outer housing connected to the first top housing; the middle housing body and the annular housing body are arranged within the outer housing, the mouthpiece is positioned on the first top housing, the installation chambers are positioned on the outer housing, and the first opening is positioned at a bottom of the outer housing;

a receiving slot is defined at a bottom of the liquid passing chamber, the annular housing body at least partially passes through the liquid passing chamber and then is placed in the receiving slot, and the liquid passing hole is positioned on the annular housing body; the liquid passing chamber is annular and surrounds an outer side of the liquid storage chamber;

a side wall of the receiving slot is equipped with a protruding position limiting ring, a slot is defined on an outer side wall of the installation seat, and the position limiting ring is placed inside the slot.

18. The electronic cigarette of claim 17, wherein the middle housing body comprises a second top housing and a middle outer housing, the middle outer housing is connected to the second top housing to form the liquid passing chamber, and the position limiting slot and the position limiting ring are both positioned on the middle outer housing; a second sealing ring is arranged between the second top housing and the middle outer housing, a third sealing ring is arranged between the annular housing body and the first top housing, and the installation seat is at least partially positioned at a bottom of the annular housing body and a bottom surface of the receiving slot.

19. The electronic cigarette of claim 18, wherein the outer housing comprises an external outer housing and a bottom housing, an upper end and a lower end of the external outer housing are respectively connected to the first top housing and the bottom housing, the first opening is positioned on the bottom housing, and the bottom housing is provided with an accommodating slot in a middle of the two installation chambers; the circuit board, the battery, and the pneumatic switch are all arranged in the accommodating slot.

* * * * *